US010989204B2

(12) United States Patent
Hung et al.

(10) Patent No.: US 10,989,204 B2
(45) Date of Patent: Apr. 27, 2021

(54) INNER-ROTOR FAN

(71) Applicant: Delta Electronics, Inc., Taoyuan (TW)

(72) Inventors: Ming-Yuan Hung, Taoyuan (TW); Chin-Wei Lin, Taoyuan (TW); Chin-Sheng Liu, Taoyuan (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 0 days.

(21) Appl. No.: 16/389,253

(22) Filed: Apr. 19, 2019

(65) Prior Publication Data

US 2019/0242389 A1 Aug. 8, 2019

Related U.S. Application Data

(63) Continuation of application No. 14/085,025, filed on Nov. 20, 2013, now abandoned.

(30) Foreign Application Priority Data

Aug. 21, 2013 (CN) ..... 201310368404.1

(51) Int. Cl.
*F04D 25/06* (2006.01)

(52) U.S. Cl.
CPC ..... *F04D 25/0606* (2013.01)

(58) Field of Classification Search
CPC .... F04D 19/002; F04D 25/0606; F04D 25/08; F04D 25/06; F04D 25/0693; F04D 29/05; F04D 29/263; F04D 29/283; F04D 29/4253; F04D 29/32; F04D 29/325; F04D 29/52; F04D 29/522; H02K 1/30; H02K 1/187; H02K 1/272–278
See application file for complete search history.

(56) References Cited

U.S. PATENT DOCUMENTS 3,084,003 A * 4/1963 Matt ..... F16C 33/08 384/278
4,547,758 A 10/1985 Shimizu et al.
4,549,858 A 10/1985 Vettori et al.
4,633,109 A 12/1986 Feigel
4,800,307 A 1/1989 Papst
(Continued)

FOREIGN PATENT DOCUMENTS

CN 102465902 A 5/2016

OTHER PUBLICATIONS

Chinese Office Action dated Mar. 28, 2016, as issued in corresponding China Patent Application No. 201310368404.1 (4 pages).
(Continued)

*Primary Examiner* — Patrick Hamo
*Assistant Examiner* — Joseph S. Herrmann
(74) *Attorney, Agent, or Firm* — Muncy, Geissler, Olds & Lowe, P.C.

(57) ABSTRACT

An inner-rotor fan includes a hub, a retaining tube, and a magnetic ring. The retaining tube is disposed in the hub, and the magnetic ring is disposed on the retaining tube. The retaining tube and the hub are formed as a single piece, and thus the stability of the fan is increased. Moreover, the magnetic flux in an inner hole of the magnetic ring is about 0 Wb, and thus an iron ring within the magnetic ring may be excluded.

9 Claims, 5 Drawing Sheets

(56) References Cited

U.S. PATENT DOCUMENTS

| | | | | |
|---|---|---|---|---|
| 4,888,512 | A * | 12/1989 | Shimizu | H01F 1/0577 310/156.43 |
| 6,387,294 | B1 * | 5/2002 | Yamashita | H01F 1/0578 252/62.54 |
| 6,537,463 | B2 | 3/2003 | Iwasaki et al. | |
| 6,992,553 | B2 * | 1/2006 | Masuzawa | H01F 7/0268 335/284 |
| 8,366,419 | B2 * | 2/2013 | Horng | F04D 25/0606 310/67 R |
| 8,568,110 | B2 | 10/2013 | Takeshita | |
| 8,579,609 | B2 * | 11/2013 | Lee | F04D 25/0606 417/423.7 |
| 9,028,223 | B2 | 5/2015 | Kitamura | |
| 9,109,607 | B2 * | 8/2015 | Takeshita | F04D 25/0606 |
| 2007/0065064 | A1 | 3/2007 | Kitamura et al. | |
| 2009/0180901 | A1 | 7/2009 | Lee et al. | |
| 2010/0066189 | A1 * | 3/2010 | Horng | H02K 1/28 310/156.09 |

OTHER PUBLICATIONS

Chinese Office Action dated Sep. 30, 2016, as issued in corresponding China Patent Application No. 201310368404.1 (4 pages).

* cited by examiner

INNER-ROTOR FAN

CROSS-REFERENCE TO RELATED APPLICATIONS

This application is a Continuation Application of pending U.S. patent application Ser. No. 14/085,025, filed on Nov. 20, 2013, which claims priority of China Patent Application No. 201310368404.1, filed on Aug. 21, 2013, the entirety of which is incorporated by reference herein.

BACKGROUND OF THE INVENTION

Field of the Invention

The present disclosure relates to a fan, and in particular, to an inner-rotor fan.

Description of the Related Art

In general, a rotor of a conventional inner-rotor fan has a hub, a shaft, and a magnetic ring around the shaft. The rotor is rotated by the magnetic field relative to the stator and the magnetic ring.

FIG. 1 is a transverse cross-sectional view of a conventional magnetic ring 1. As shown in FIG. 1, the magnetic ring 1 includes a plurality of south poles S and north poles N alternately arranged. Each of the south poles S and the north poles N are exposed from the inner wall 11 and the outer wall 12 of the magnetic ring 1. Therefore, the magnetic field generated by the magnetic ring 1 is distributed in an inner hole 13 of the magnetic ring 1, and the rotational stability of the fan is decreased.

To solve the described problem, an iron ring is installed in the hub of the fan. The iron ring passes through the inner hole 13 and fixed on the inner wall 11 of the magnetic ring 1. However, the iron ring is made of metal, and thus the manufacturing cost of the inner-rotor fan is increased. Furthermore, the iron ring and the hub are not formed as a single piece, and thus the rotational stability of the fan is decreased

BRIEF SUMMARY OF THE INVENTION

To solve the described problems, an object of the present disclosure is to decrease the manufacturing cost of the inner-rotor fans, and to increase to rotational stability of the inner-rotor fans.

The present disclosure provides an inner-rotor fan including a fan frame, a bearing, and a rotor. The bearing is disposed on the fan frame. The rotor includes a hub, a retaining tube, a magnetic ring, a shaft and a plurality of blades. The retaining tube is disposed in the hub. The magnetic ring has an inner hole, and the retaining tube is disposed in the inner hole. The shaft is disposed on the hub, located in the retaining tube, and passes through the bearing. The blades are respectively disposed around the hub. The magnetic ring is one-piece formed and in direct contact with the retaining tube, the retaining tube and the hub are formed as a single piece, and the retaining tube and the hub have the same material and are made of plastic. The magnetic ring is a plastic magnetic ring, and made of magnetic powder and plastic. The inner-rotor fan excludes an iron ring disposed on an inner wall of the magnetic ring and between the magnetic ring and the shaft.

In conclusion, the inner-rotor fan of the present disclosure has a magnetic ring with about 0 Wb of magnetic flux in the inner hole thereof, and therefore, the iron ring is excluded to decrease the manufacturing cost of the inner-rotor fan. Moreover, since the retaining tube and the hub are formed as a single piece, the rotational stability of the inner-rotor fan is increased.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
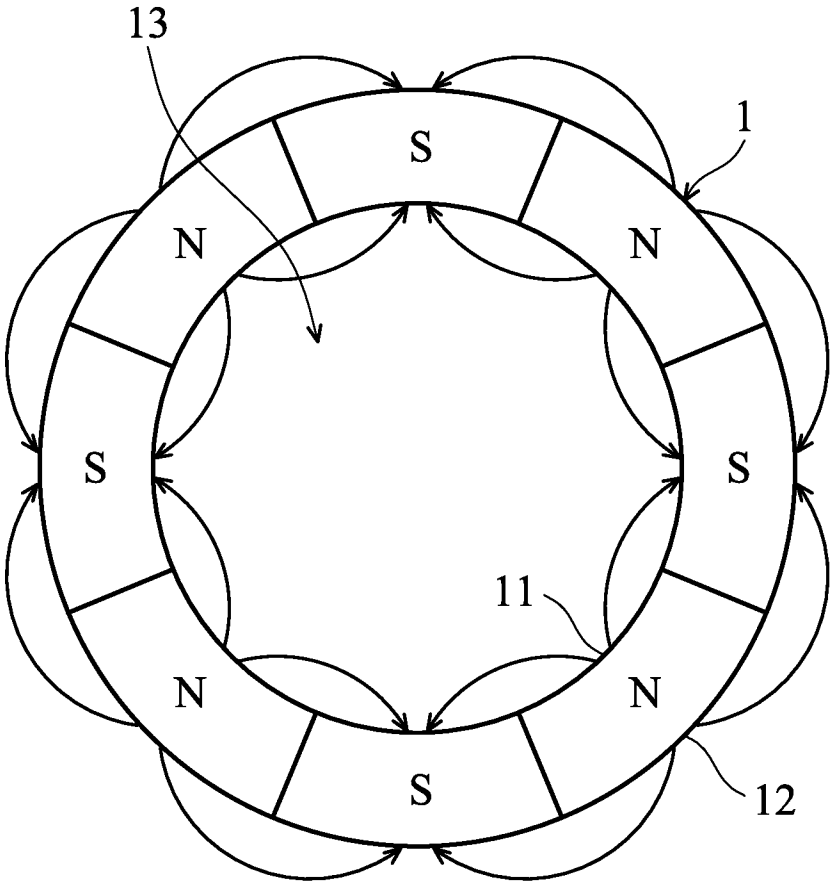
FIG. 1 ( PRIOR ART )
FIG. 1 is a transverse cross-sectional view of a conventional magnetic ring.
Figure 2:
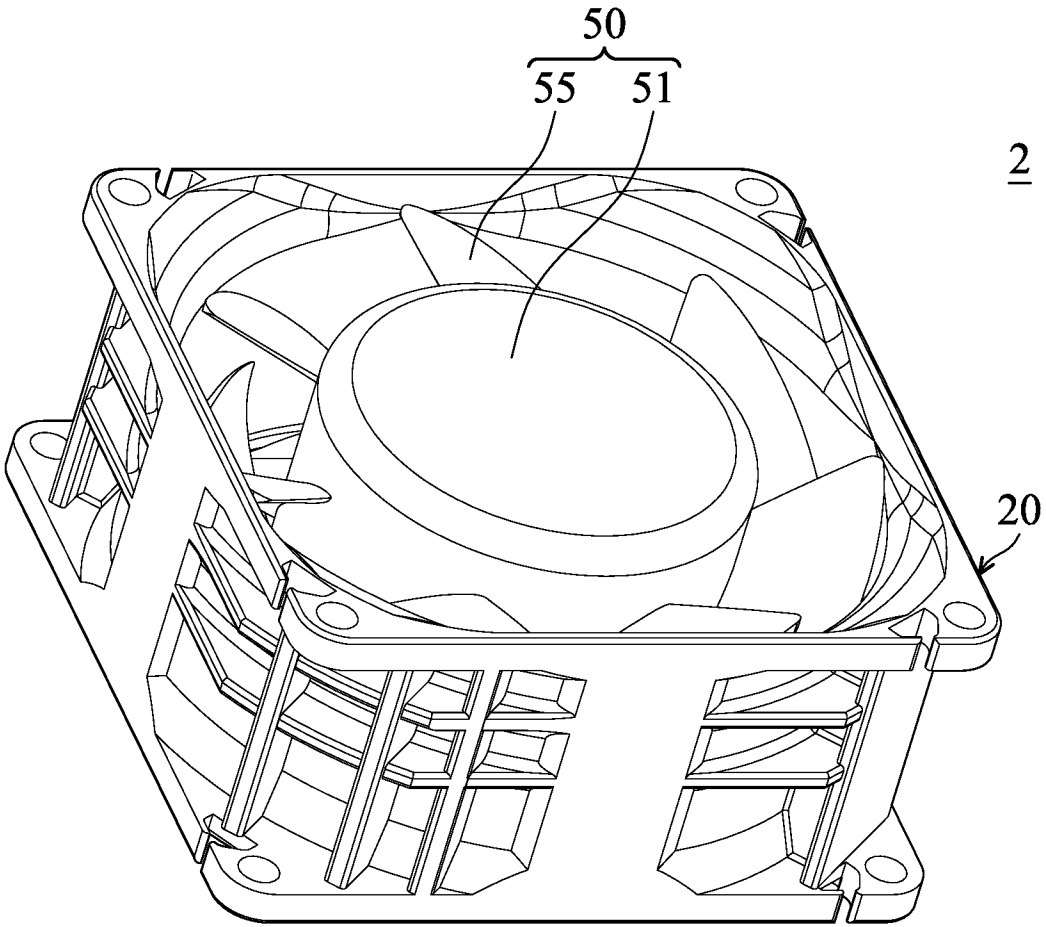
FIG. 2 is a perspective view of an inner-rotor fan according to the present disclosure.
Figure 3:
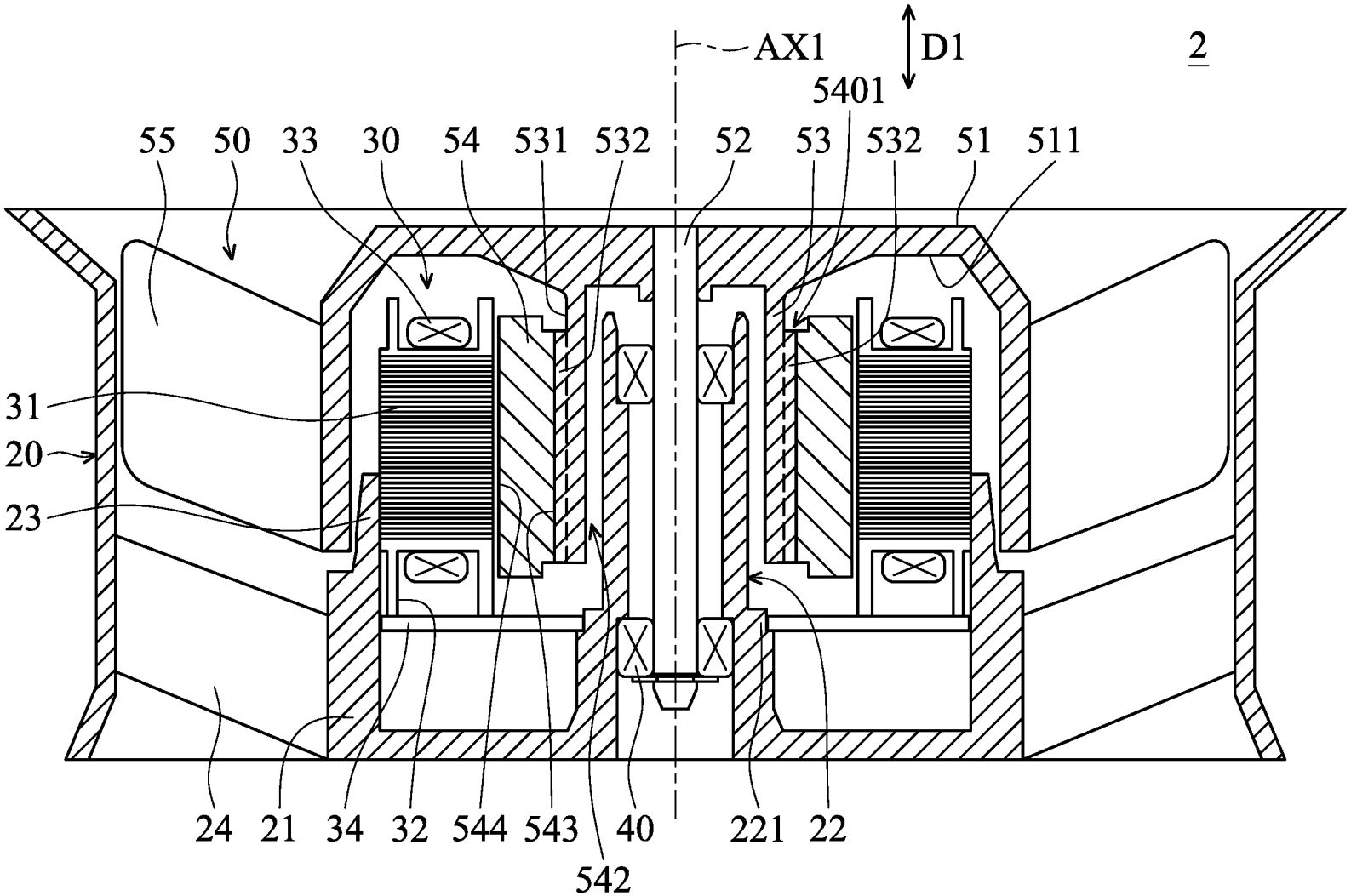
FIG. 3 is a cross-sectional view of the inner-rotor fan according to the present disclosure.
Figure 4:
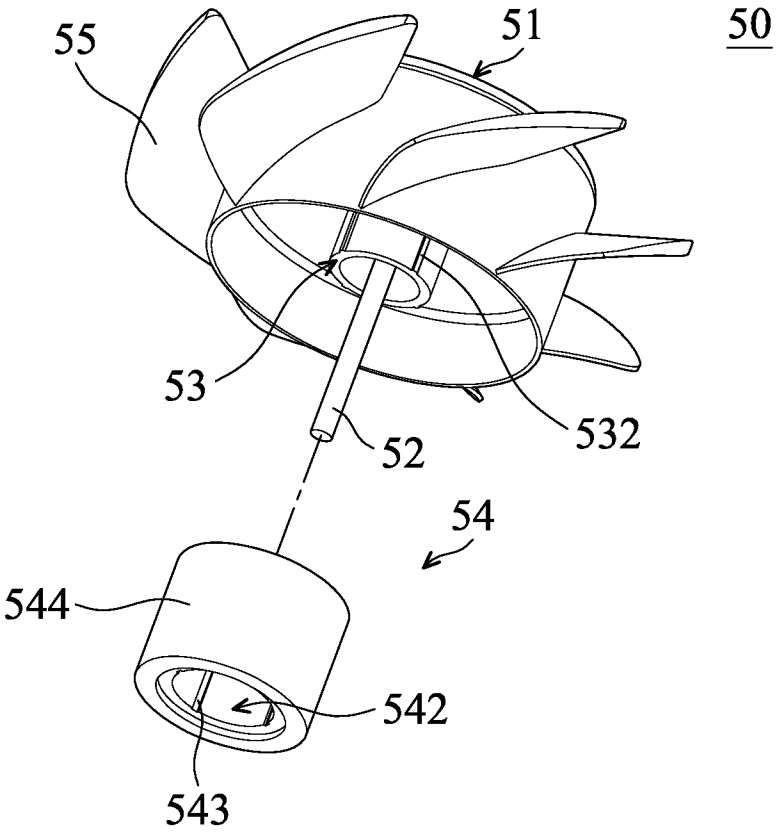
FIG. 4 is an exploded view of a rotor according to the present disclosure.

FIG. 2 is a perspective view of an inner-rotor fan 2 according to the present disclosure. FIG. 3 is a cross-sectional view of the inner-rotor fan 2 according to the present disclosure. FIG. 4 is an exploded view of a rotor 50 according to the present disclosure. As shown in FIGS. 2, 3 and 4, the inner-rotor fan 2 includes a fan frame 20, a stator 30, a bearing 40, and a rotor 50. The fan frame 20 includes a base 21, a sleeve 22, a holding portion 23, and a plurality of support ribs 24 connected to the base 21. The sleeve 22 and the holding portion 23 are a tube structure disposed on the base 21 and extended along an extension direction D1. In some embodiments, the extension direction D1 is perpendicular to the base 21. The base 21, the sleeve 22, and the holding portion 23 are formed as a single piece, or are independent parts according to a variety of designs. Moreover, the sleeve 22 is located in the retaining tube 53.

The stator 30 is fixed on the holding portion 23. The stator 30 includes a metal element 31, a holding rack 32, a coil 33, and an electric power board 34. The metal element 31 is disposed on the holding rack 32. In some embodiments, the metal element 31 is made of silicon steel sheets. The metal element 31 is covered by an insulation layer and is insulated relative to the coil 33. In some embodiments, the metal element 31 is made of magnetic material.

The coil 33 is wound to the holding rack 32 and the metal element 31, and corresponds to the magnetic ring 54. The electric power board 34 is fixed on the inner wall of the holding portion 23 and a support portion 221 of the sleeve 22. Further, the electric power board 34 is electrically connected to the coil 33. The holding rack 32 is fixed on the electric power board 34. The bearing 40 is fixed in the sleeve 22, and extended along an axis AX1. In some embodiments, the extension direction D1 is parallel to axis AX1.

The rotor 50 includes a hub 51, a shaft 52, a retaining tube 53, a magnetic ring 54, and a plurality of blades 55. The hub 51 is a hollow structure, and the center of the hub 51 is located at the axis AX1. The stator 30 and the bearing 40 are located in the hub 51.

The shaft 52 is disposed in the hub 51, extended along the axis AX1, and passes through the bearing 40. The retaining tube 53 is a tube structure disposed on an inner surface 511 of the hub 51 and extended along the extension direction D1. The retaining tube 53 is around the shaft 52, the sleeve 22, and the bearing 40. A plurality of first positioning structures 532 is disposed on an outer surface 531 of the retaining tube 53.

The magnetic ring 54 is a tube structure extended along the extension direction D1. The magnetic ring 54 is disposed on the retaining tube 53 and corresponds to the stator 30. The magnetic ring 54 has an inner wall 541, an inner hole 542, a plurality of second positioning structures 543, and an outer wall 544 facing the stator 30. The inner wall 541 forms an inner hole 542 extended along the axis AX1, and the retaining tube 53 is disposed on the inner hole 542. The second positioning structure 543 is disposed on the inner wall 541. The first positioning structure 532 is retained on the second positioning structure 543 to make the magnetic ring 54 rotate following the retaining tube 53.

In the embodiment, the first positioning structure 532 is a rib extended along the extension direction D1, and the second positioning structure 543 is a groove extended along the extension direction D1. Further, the rib is located in the groove. In another embodiment, the first positioning structure 532 is a groove, and the second positioning structure 543 is a rib. Furthermore, in a situation where the magnetic field corresponding to the coil 33 is not influenced, a groove 5401 may be formed on a magnetic ring 54 adjacent to the retaining tube 53. The weight of the rotor 50 is decreased by the groove 5401. Furthermore, a balancing material may be disposed in the groove 5401 to balance the rotation of the rotor 50. Therefore, the vibration of the inner-rotor fan 2 is decreased.

The blades 55 are arranged around the hub 51. In the embodiment, when power is applied to the coil 33, the rotor 50 is rotated by an alternating magnetic field between the coil 33 and the magnetic ring 54.

In the embodiment, the magnetic ring 54 is a plastic magnetic ring 54 made of magnetic powder and plastic. The magnetic powder is distributed in the plastic. Before the plastic is solidified, a magnetic field is applied to the magnetic ring 54 to change the arrangement of the magnetic powder. After the plastic is solidified, the arrangement of the magnetic powder is fixed to make the plastic magnetic ring 54 generate a predetermined magnetic field.

Figure 5:
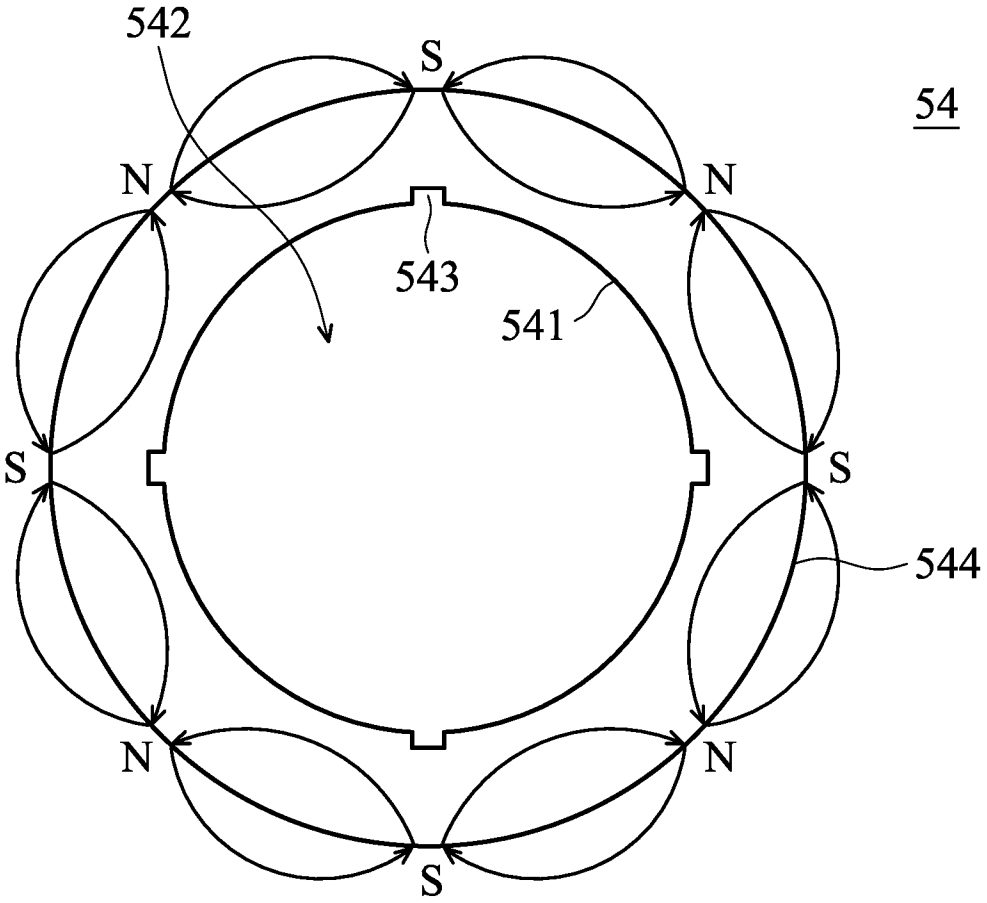
FIG. 5 is a transverse cross-sectional view of the magnetic ring according to the present disclosure.

FIG. 5 is a transverse cross-sectional view of the magnetic ring 54 according to the present disclosure. As shown in FIG. 5, the south poles S and the north poles N of the magnetic ring 54 of this embodiment are alternately arranged on the magnetic ring 54 and adjacent to the outer wall 544 of the magnetic ring 54. Therefore, the magnetic field does not (or little) pass through the inner wall 541 of the magnetic ring 54. Therefore, the magnetic flux in the inner hole 542 is about 0 Wb.

Since the magnetic flux in the inner hole 542 of the magnetic ring 54 is about 0 Wb, the inner-rotor fan 2 of the embodiment excludes a magnetic field shielding element (such as an iron ring) disposed on an inner wall 541 of the magnetic ring 54 (or between the magnetic ring 54 and the shaft 52). Therefore, the manufacturing cost of the inner-rotor fan 2 is decreased.

Further, since the embodiment excludes the magnetic field shielding element made of metal, the retaining tube 53 may be made of cheaper plastic, and thus the manufacturing cost of the inner-rotor fan 2 is decreased. In addition, the hub 51 and the retaining tube 53 have the same material, and the hub 51 and the retaining tube 53 are made of plastic. Therefore, the retaining tube 53 and the hub 51 are easily formed as a single piece, and the rotational stability of the rotor 50 is increased.

Moreover, since the retaining tube 53 is made of plastic, the positioning structure is easily formed on the retaining tube 53 to limit the rotation between the magnetic ring 54 and the retaining tube 53, increasing the rotational stability of the rotor 50.

In conclusion, the inner-rotor fan of the present disclosure has a magnetic ring with about 0 Wb of magnetic flux in the inner hole thereof, and therefore, the iron ring is excluded to decrease the manufacturing cost of the inner-rotor fan. Moreover, since the retaining tube and the hub are formed as a single piece, the rotational stability of the inner-rotor fan is increased.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inner-rotor fan, comprising a fan frame;

a bearing disposed in a sleeve portion of the fan frame, and a rotor comprising:

a hub;

a retaining tube disposed in the hub;

a magnetic ring, having an inner hole, wherein the retaining tube is disposed in the inner hole;

a shaft, disposed on the hub; and located within the retaining tube, wherein the shaft has a constant cross-section portion passing through the bearing, an end of the constant cross-section portion is flush with a top surface of the hub, and an axial gap is formed within the sleeve portion between a bottom surface of the hub and a top surface of the bearing;

a plurality of blades disposed around the hub, wherein the magnetic ring is one-piece formed and in direct contact with the retaining tube, the retaining tube and the hub are formed as a single piece, and the retaining tube and the hub have the same material and are made of plastic, wherein the magnetic ring is a plastic magnetic ring, and made of magnetic powder and plastic, wherein the inner-rotor fan excludes an iron ring disposed on an inner wall of the plastic magnetic ring and between the plastic magnetic ring and the shaft;

wherein a plurality of south poles and a plurality of north poles of the plastic magnetic ring are alternately arranged on the plastic magnetic ring and adjacent to an outer wall of the plastic magnetic ring;

wherein a plurality of ribs are formed on an outer surface of the retaining tube, the ribs protrude from the outer surface of the retaining tube, and the plurality of ribs extend a predetermined length in a direction that is parallel with an extending direction of the shaft;

wherein a plurality of grooves having open axial ends are formed on the inner wall of the plastic magnetic ring, the grooves are recessed from the inner wall of the plastic magnetic ring, and the plurality of grooves extend the predetermined length in a direction that is parallel with the extending direction of the shaft; and wherein each of the ribs is correspondingly engaged with each of the grooves.

2. The inner-rotor fan as claimed in claim 1, wherein a magnetic flux in the inner hole is 0 Wb.

3. The inner-rotor fan as claimed in claim 1, wherein the plastic magnetic ring has a groove adjacent to the retaining tube, and a balancing material is disposed in the groove adjacent to the retaining tube.

4. The inner-rotor fan as claimed in claim 1, wherein magnetic field generated by the plastic magnetic ring does not pass through the inner wall of the plastic magnetic ring, and the inner hole is formed by the inner wall.

5. The inner-rotor fan as claimed in claim 1, wherein the plurality of south poles and the plurality of north poles of the plastic magnetic ring are not arranged on the inner wall of the plastic magnetic ring, and the inner hole is formed by the inner wall.

6. The inner-rotor fan as claimed in claim 1, wherein the fan frame comprises a base and the sleeve portion is disposed on the base.

7. The inner-rotor fan as claimed in claim 6, wherein the fan frame further comprises a holding portion disposed on the base and around the sleeve portion.

8. The inner-rotor fan as claimed in claim 7, further comprising a stator disposed on the holding portion, and corresponding to the plastic magnetic ring.

9. The inner-rotor fan as claimed in claim 8, wherein the sleeve portion further comprises a support portion, the stator further comprises an electric power board fixed on the support portion and a coil electrically connected with the electric power board and corresponding to the plastic magnetic ring.

* * * * *